US006076440A

United States Patent [19]

Hsu

[11] Patent Number: 6,076,440

[45] Date of Patent: Jun. 20, 2000

[54] TOOL ASSEMBLY

[75] Inventor: Huang-Tung Hsu, Taichung Hsien, Taiwan

[73] Assignee: Chu Min Co., Ltd., Taichung, Taiwan

[21] Appl. No.: 09/200,727

[22] Filed: Nov. 27, 1998

[51] Int. Cl.[7] ..... B25G 1/08

[52] U.S. Cl. ..... 81/490; 81/177.4

[58] Field of Search ..... 81/177.1, 177.2, 81/177.4, 489, 490

[56] References Cited

U.S. PATENT DOCUMENTS 4,449,559 5/1984 Martinmass ..... 81/177.4
5,881,615 3/1999 Dahl et al. ..... 81/490
5,916,341 6/1999 Lin ..... 81/490 X

*Primary Examiner*—James G. Smith
*Attorney, Agent, or Firm*—Rosenberg, Klein & Lee

[57] ABSTRACT

A tool assembly includes a handle having an engaging hole for receiving the bar of a tool member therein, the handle having a plurality of concavities defined in the outside thereof and a plurality of longitudinal recesses defined therein so that each of the concavities receives the bar of the tool member and each of the longitudinal recesses receives the bit of the tool member. A passage is defined in the handle and communicates with the engaging hole so that when the bar of the tool member is tightly engaged with the engaging hole, a rod is inserted into the passage to push the bar out from the engaging hole.

5 Claims, 4 Drawing Sheets

TOOL ASSEMBLY

FIELD OF THE INVENTION

The present invention relates to a tool, and more particularly, to a tool assembly composed of a handle with an engaging hole for engaged with a tool member and a plurality of concavities and longitudinal recesses defined in the outside of the handle so as to receive different tool members therein.

BACKGROUND OF THE INVENTION

A conventional tool such as a screw driver has only one function which is adapted to tighten or loosen a bolt or a nut. The users always need to use different types of tools during working so that the users have to carry many tools. This makes the tool box heavy and sometimes, in a narrow space, the tool box is difficult to be brought in. In order to improve the situation and provide a tool having a small size and more than one function, a multi-functions tool having many replaceable bits is developed. Such a multi-functions tool generally has a handle with an engaging hole and the replaceable bits are received in a tool box. Although the users now need to carry only one handle, the bits are still to be received in the tool box so that the inherent shortcoming is not yet removed.

The present invention intends to provide a tool assembly which has a handle to which a plurality of tool members are engaged. With the tool assembly of the present invention, the users simply carries the tool assembly and a lot of different functions can be gained. The present invention has arisen to mitigate and/or obviate the disadvantage of the conventional tool.

SUMMARY OF THE INVENTION

In accordance with one aspect of the present invention, there is provided a tool assembly comprising a handle having an engaging hole defined in the first end thereof and the engaging hole defined by a polygonal inner periphery so as to receive the bar of the tool member. The handle has a plurality of concavities defined in the outside thereof and a plurality of longitudinal recesses defined in the handle, each of the concavities communicating with respective one of the longitudinal recesses and defined by a polygonal inner periphery so that the bars of the tool members are received in the concavities and the bits of the tool members are received in the longitudinal recesses.

The object of the present invention is to provide a tool assembly which comprises a plurality of different types of tool members attached to the handle of the assembly so that the user carries the tool assembly may gain different functions performed by the tool members.

Further objects, advantages, and features of the present invention will become apparent from the following detailed description with appropriate reference to the accompanying drawings.

DETAILED DESCRIPTION OF THE PREFERRED EMBODIMENTS

Figure 1:
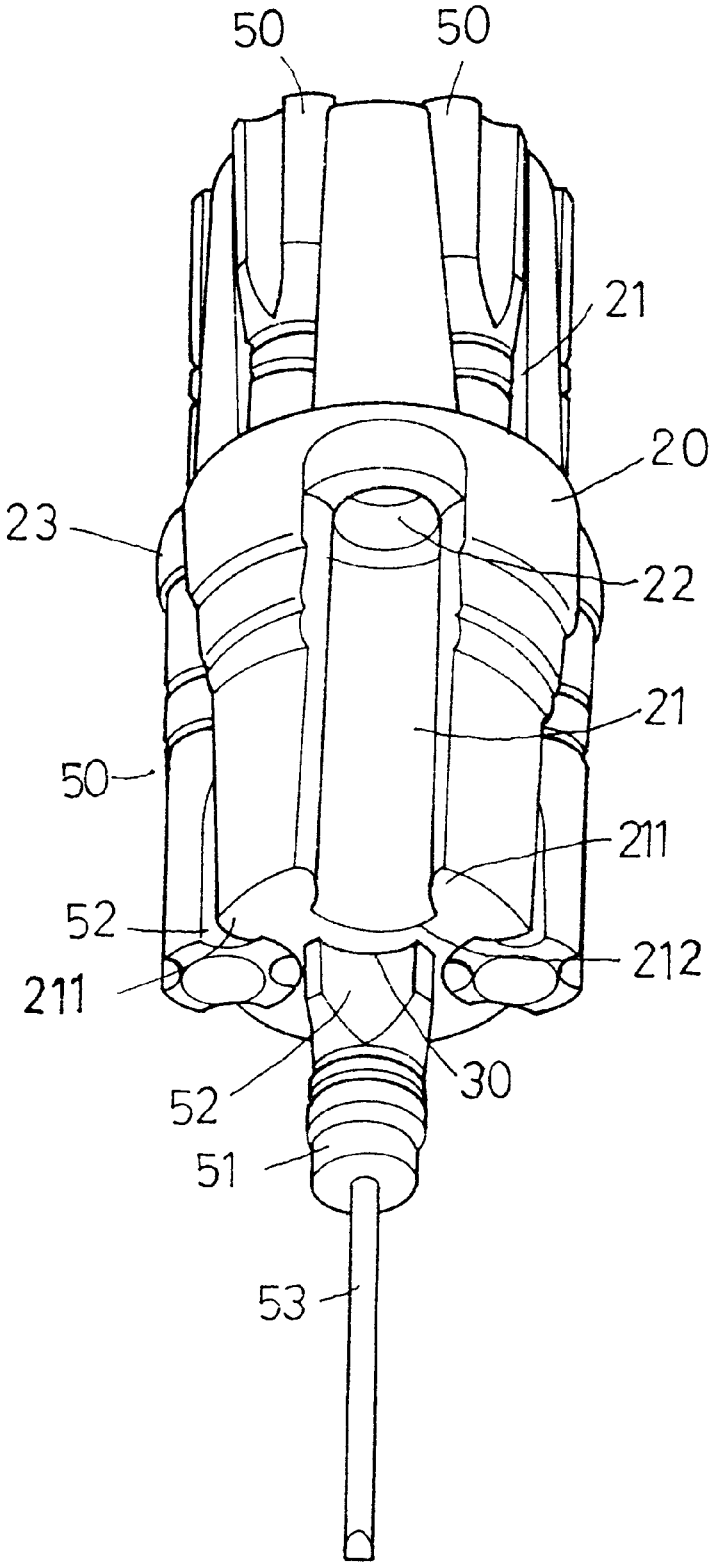
FIG. 1 is a perspective view of the tool assembly in accordance with the present invention.
Figure 2:
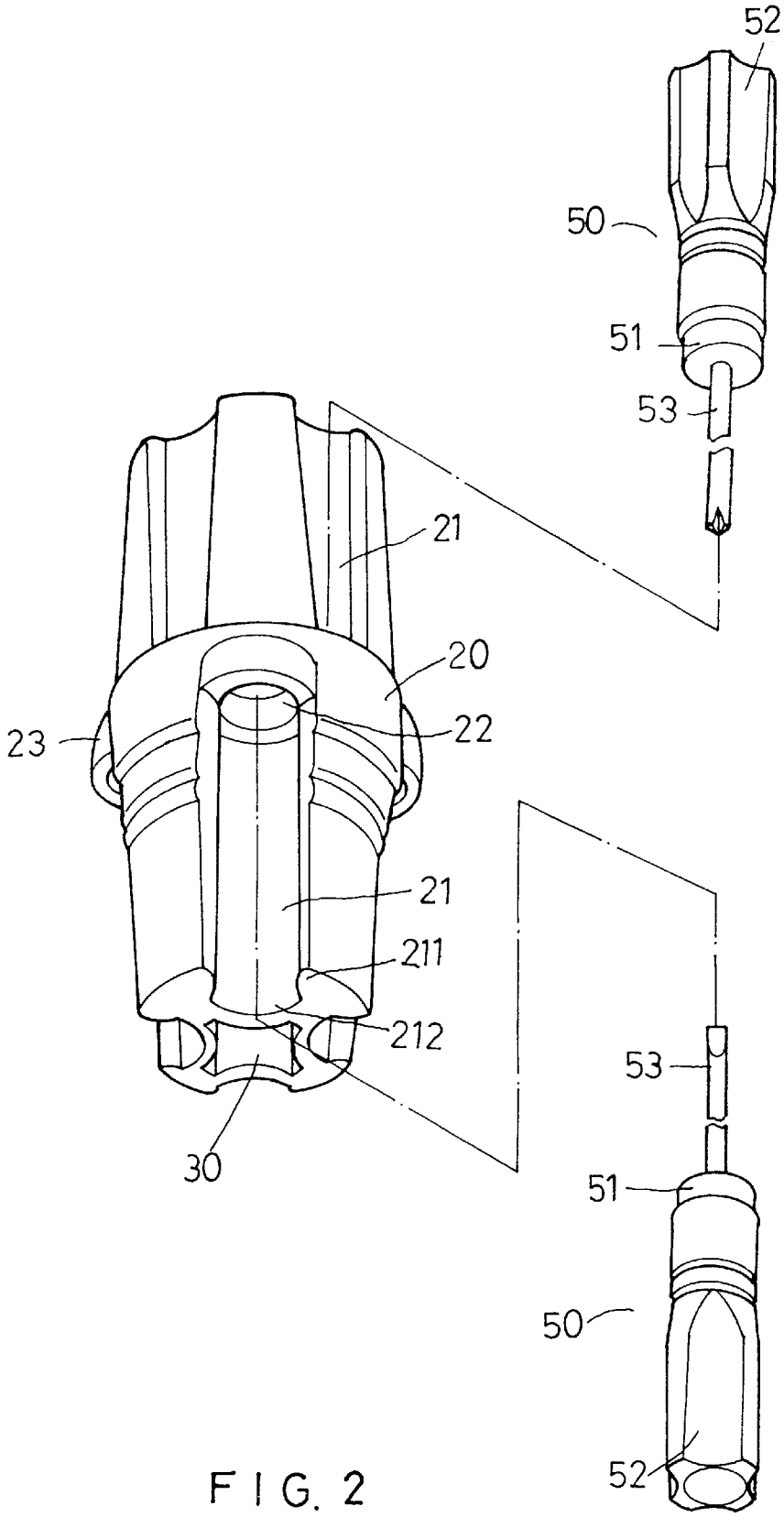
FIG. 2 is an exploded view of the tool assembly in accordance with the present invention.
Figure 3:
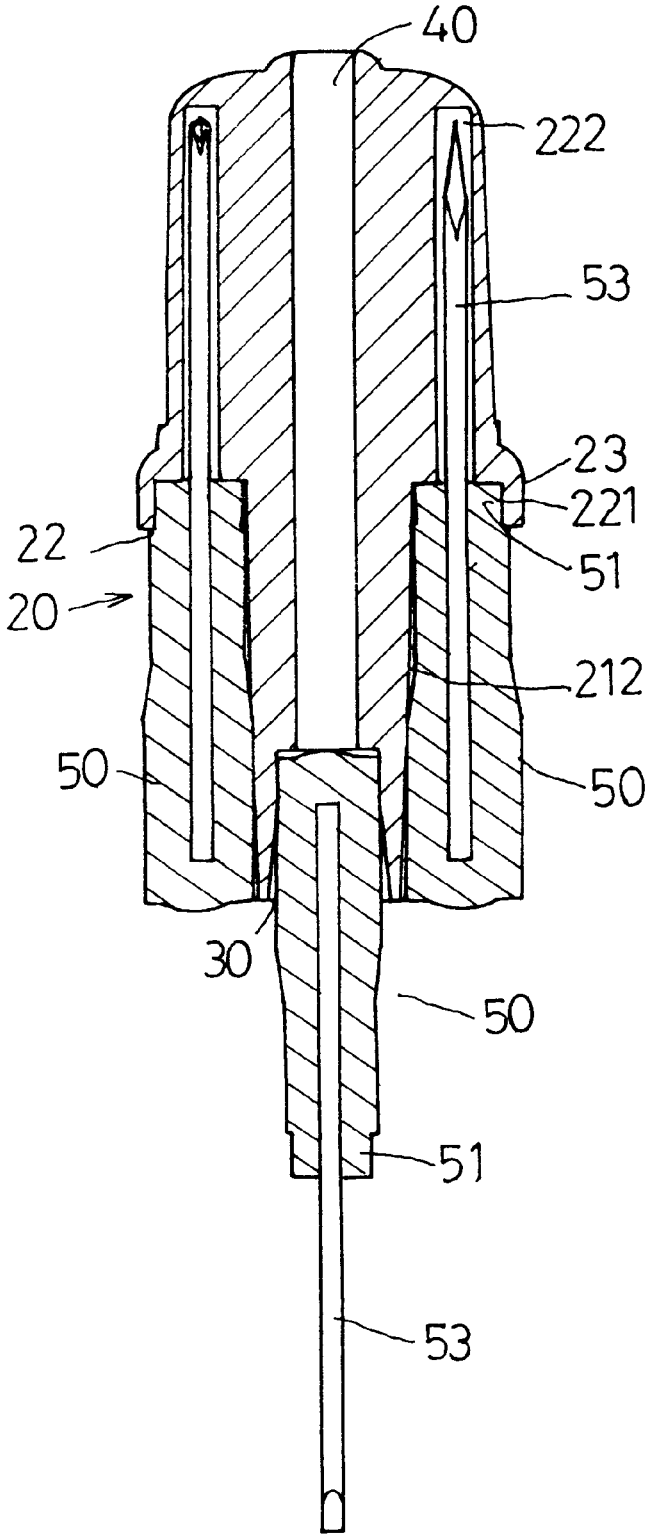
FIG. 3 is a side elevational view, partly in section, of the tool assembly in accordance with the present invention.
Figure 4:
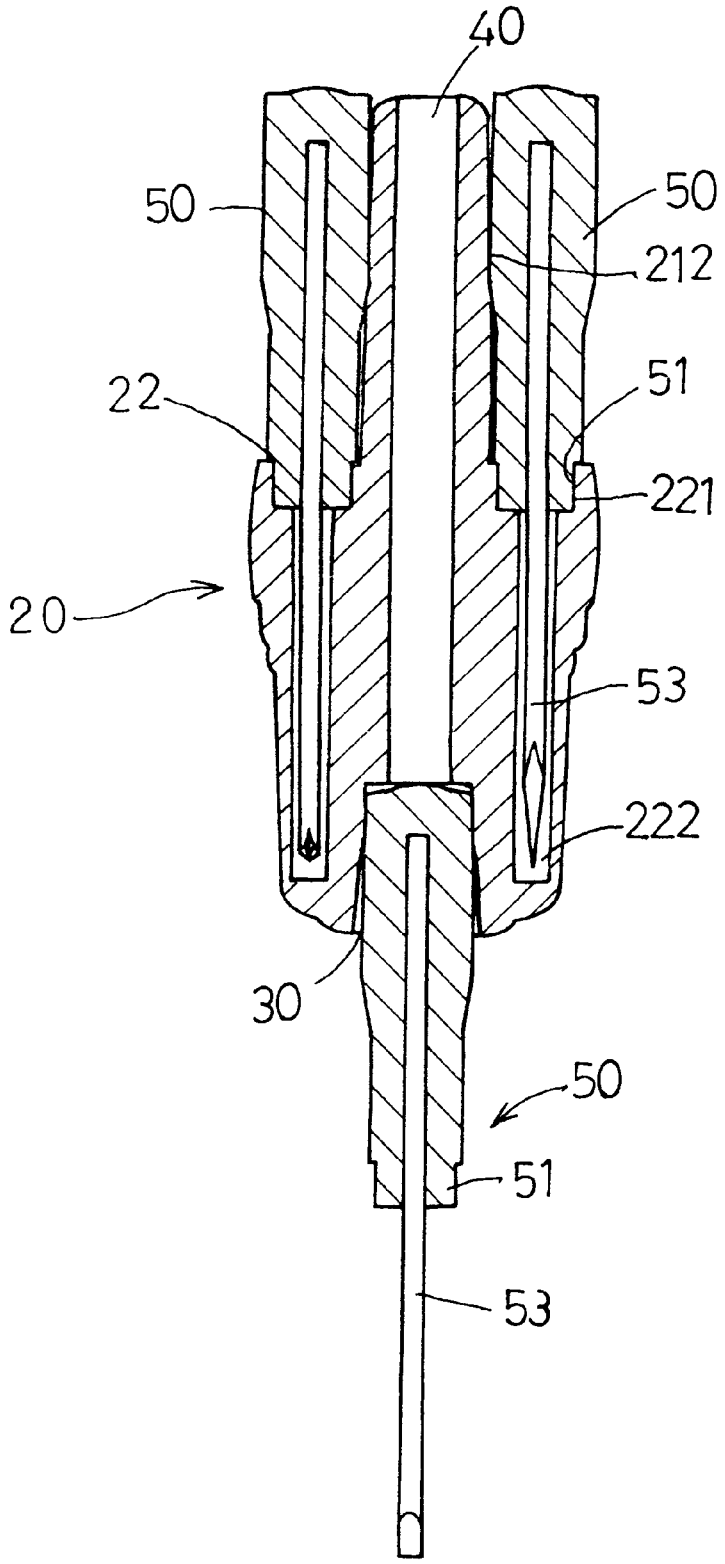
FIG. 4 is a side elevational view, partly in section, of the tool assembly when view from another side.

Referring to FIGS. 1 to 4, the tool assembly in accordance with the present invention comprises a handle 20 having an engaging hole 30 defined in the first end thereof and the engaging hole 30 defined by a polygonal inner periphery which is cruciform in this embodiment. A passage 40 is defined in the second end of the handle 20 and communicates with the engaging hole 30.

The handle 20 has a plurality of concavities 21 defined in the outside thereof and the concavities 21 are arranged alternatively along the longitudinal direction of the handle 20. A plurality of longitudinal recesses 222 are defined in the handle 20 and arranged alternatively so that each of the concavities 21 communicate with a respective one of the longitudinal recesses 222. Each of the concavities 21 is defined by a polygonal inner peripheral surface contour 212 which is complementary to the contour of the bar 52 of the tool members 50. Similarly, the engaging hole 30 has a polygonal interior peripheral surface contour located at the first end of the handle 20. A plurality of rail members 23 extend radially outward from the handle 20 and each of the concavities 21 having a flange 22 extending radially outward therefrom so that an annular section 24 is defined by the rail member 23 and the flange 22.

A plurality of tool members 50 each have a bar 52 with a polygonal cross section which is disengagably received in the engaging hole 30 and disengagably engaged with either one of the concavities 21. A cylindrical portion 51 extends from one of two ends of each of the bars 52 and each of the cylindrical portions 51 has a bit 53 extending therefrom.

Accordingly, thanks to the polygonal inner peripheral surface contour 212, the bar 52 can be conveniently engaged with and disengaged from the concavity 21 with its bit 53 received in the longitudinal recess 222 and its cylindrical portion 51 engaged with the annular section 24. Because the shape of the bar 52 is polygonal so that it can be well retained in the concavity 21, that is to say, the cruciform bar 52 will be retained by the two protrusions 211 defining the concavity 21.

When in use, the desired tool member 50 is pulled from the longitudinal recess 222 and the concavity 21, and the bar 52 is inserted into the engaging hole 30 so that a torque is applied to the object such as a bolt or a nut by rotating the handle 20. If the bar 52 is fitted in the engaging hole 30 so tightly that it is difficult to be pulled out from the engaging hole 30, a rod (not shown) can be inserted into the passage 40 and pushes the bar 52 out from the engaging hole 30 easily.

The invention is not limited to the above embodiment but various modification thereof may be made. It will be understood by those skilled in the art that various changes in form and detail may made without departing from the scope and spirit of the present invention.

What is claimed is:

1. A tool assembly comprising:

a handle having an engaging hole defined in a first end thereof, said engaging hole having a polygonal interior peripheral surface contour, said handle having a plurality of concavities defined in an outer surface thereof and a plurality of longitudinal recesses defined in said handle, each of said concavities being in open communication with a respective one of said longitudinal recesses and having a polygonal inner peripheral surface contour; and a plurality of tool members each having a bar with a polygonal cross-sectional contour, said bar being disengagably received in said engaging hole and disengagably engaged with either one of said concavities, each of said bars having a bit extending therefrom.

2. The tool assembly as claimed in claim 1 further comprising a cylindrical portion extending from one of two ends of each of said bars and each of said cylindrical portions having said bit extending therefrom.

3. The tool assembly as claimed in claim 2 further comprising a plurality of rail members extending radially outward from said handle in correspondence with said plurality of concavities, each of said concavities having a flange extending radially outward therefrom so that an annular section is defined by a corresponding one of said rail members and said flange, said annular section receiving said cylindrical portion of said tool member therein.

4. The tool assembly as claimed in claim 1, wherein said polygonal interior peripheral surface contour of said engaging hole is cruciform.

5. The tool assembly as claimed in claim 1 further comprising a passage defined in a second end of said handle, said passage being in open communication with said engaging hole.

* * * * *